US005540030A

United States Patent [19]

Morrow

[11] Patent Number: 5,540,030

[45] Date of Patent: Jul. 30, 1996

[54] PROCESS FOR THE GROUTING OF UNBONDED POST-TENSIONED CABLES

[76] Inventor: Jack A. Morrow, Suite 200, #3 317-37 Avenue N.E., Calgary, Alberta, Canada, T2E 6P6

[21] Appl. No.: 269,705

[22] Filed: Jul. 1, 1994

[51] Int. Cl.[6] ..... E02D 31/02

[52] U.S. Cl. ..... 52/742.13; 52/742.16; 52/223.1; 264/36; 264/228

[58] Field of Search ..... 52/223.6, 223.8, 52/742.1, 742.13, 742.14, 742.16, 745.21; 269/35, 36, 228, 229, 262

[56] References Cited

U.S. PATENT DOCUMENTS

| | | | |
|---|---|---|---|
| 3,501,564 | 3/1970 | Snecyeabes | 264/255 |
| 3,639,567 | 2/1972 | Hervig | 264/45 |
| 3,980,807 | 9/1976 | Woytiuk | 174/107 |
| 4,693,044 | 9/1987 | Jartoux | 52/746.16 X |
| 4,718,965 | 1/1988 | Finsterwalder et al. | 52/223.14 X |
| 4,744,193 | 5/1988 | Hatsuzaki et al. | 52/744 |
| 4,849,282 | 7/1989 | Watanabe | 264/228 X |
| 4,977,715 | 12/1990 | Krumbach | 52/223.14 |
| 5,079,879 | 1/1992 | Rodriguez | 52/233 |
| 5,138,808 | 8/1992 | Bengtson et al. | 52/204 |
| 5,348,764 | 9/1994 | Yokoshima | 264/36 X |

FOREIGN PATENT DOCUMENTS

| | | |
|---|---|---|
| 943785 | 3/1974 | Canada . |
| 1005465 | 2/1977 | Canada . |
| 1007068 | 3/1977 | Canada . |
| 1225253 | 8/1987 | Canada . |

*Primary Examiner*—Carl D. Friedman
*Assistant Examiner*—Beth A. Aubrey
*Attorney, Agent, or Firm*—Andrus, Sceales, Starke & Sawall

[57] ABSTRACT

A method for the grouting of an unbonded post-tensioned cable in a concrete structure which cable is enclosed in a cable sheath is disclosed. The method includes the steps of pumping a curable hydrophobic grouting material, for example a polyurethane resin into the cable sheath to fill a selected length of the cable sheath with the grouting material and continuing the injection until the selected length of the sheath is filled with the grouting material and the material expelled from the sheath no longer includes any admixed water. Infiltrated water in the cable sheath is expelled by way of the injected grouting material so that corrosion of the cable is stopped and further corrosion prevented. The grouting material also bonds to the cable and the sheath thereby preventing a sudden eruption of the cable from the surrounding building structure should the cable break.

9 Claims, 1 Drawing Sheet

PROCESS FOR THE GROUTING OF UNBONDED POST-TENSIONED CABLES

FIELD OF THE INVENTION

The invention relates to post-tensioned concrete structures and, more particularly, to a method for the grouting of post-tensioned cables therein.

BACKGROUND OF THE INVENTION

For more than 30 years, unbonded post-tensioned cables have been used in concrete structures such as parking garages, apartment and office buildings, etc. Generally, steel cables of high tensile strength which are encased in plastic or impregnated paper sheaths are used. The concrete structure which is to be subjected to a tensile load, is formed with hollow sheaths or ducts, positioned in the direction of the highest expected tensile load. Enclosed in the sheath is a post-tensioning cable. The cable and sheath combinations are placed in the concrete forms prior to filling thereof and, once the concrete has attained a specific compressive strength, the cables are tensioned by way of anchors placed at either end thereof. Hydraulic jacks are used to stress or elongate the cables and the cables are locked in their anchors by wedges before the hydraulic jacks are removed. The tension in the steel cables imparts a prestress force to the concrete and gives it the capacity to support its own weight and the anticipated load to be applied to the structure. Thus, when the concrete structure is later put into use under tensile load conditions, any tensile load applied in the direction of the prestressing will, up to the degree of applied prestress, serve merely to relieve the compressive stresses upon the concrete structure while not placing the structure under actual tension Because the tensile load bearing capacity of the concrete structure depends almost exclusively on the tensile stress carrying capabilities of the cables, corrosion of the cables, which is usually caused by water that infiltrated the cable sheath, must be prevented to guarantee the integrity of the structure. In order to maintain the reliability of the cables during the anticipated service life of the structure, each cable is provided with a protective film of grease applied during manufacture. Nevertheless, since the early 1980's reports of corroded cables have been accumulating. Numerous incidents have been reported where a post-tensioned cable was corroded to the point where it would break. However, once such a highly tensioned cable breaks, the sudden release of the energy stored in the cable can result in the cable shooting out the edge of a concrete slab or bursting through the top or bottom thereof which could lead to serious injury of a person standing within reach of the failed cable. Thus, post-tensioned concrete structures with corroded cables potentially pose great danger to human life and a means is desired which will greatly reduce and preferably stop the corrosion of an installed post-tensioned cable. There also exists the need for a means which will provide a sufficiently large bond between an installed post-tensioned cable and the surrounding concrete structure to prevent a sudden release of the stored energy should the cable break. Methods and materials used for the grouting of post-tensioned cables are disclosed in the following patents:

U.S. Pat. No. 5,079,879 to Rodriguez;

U.S. Pat. No. 5,138,808 to Bengtson et al;

Canadian Patent No. 1,005,465 to Schupack; and

Canadian Patent No. 1,225,253 to Harris et al.

Rodriguez (U.S. 5,079,879) discloses the use of a foam filler for the sealing of a tubular anchor plate extension which surrounds a tendon at the anchor plate. However, the foam is placed prior to the pouring of the concrete and only around that portion of the cable which is inside the extension and not in the void between the cable and its sheath. The problem of corrosion of post-tensioned cables in existing concrete structures is not addressed.

Bengtson et al (U.S. 5,138,808) teach a wall structure of hollow, loosely stacked masonry blocks which are held together by post-tensioning rods and are filled with a polyurethane foam for increased heat insulation. Again, neither the corrosion problems encountered with post-tensioned cables in existing concrete structures nor any solutions thereto are disclosed. The polyurethane foam is not used for grouting purposes, but only functions as insulating material. The significant differences in bonding and setting properties between hydrophillic and hydrophobic polyurethane resins are not disclosed.

Schupack (CA 1,005,465) teaches the grouting of post-tensioned cables with a concrete mixture. He acknowledges that excess water in the concrete grouting mixture poses a big problem, since it can result in a lack of bonding or sealing and, subsequently, lead to corrosion of the cable. However, in the sealing of existing non-grouted post-stressed tendons which have been in service for some years and possibly subject to water infiltration, it is hard, if not impossible, to predict the amount of water accumulated within the cable sheath. Furthermore, many generally horizontally extending tendons are not level but have rising and declining portions so that infiltrated water accumulates in pockets at the low points of the cable sheath. It will be readily appreciated by the skilled artisan that these pockets of water seriously impede the effectiveness of a cement grout. The use of non-cementous grouting material is not discussed.

Harris et al (CA 1,225,253) disclose the use of a hydrophillic epoxy resin for the grouting of post-tensioned cables. However, differing amounts of water present in the cable sheath will affect the curing and bonding properties of the resin composition. The resin will not fully cure, if insufficient water is present in the sheath. On the other hand, if more water is present in the sheath than is required for the resin to fully cure, some residual water will remain which can lead to additional corrosion of the cable. The use of grouting compositions other than hydrophillic epoxy resin is not disclosed.

Although these patents provide some guidance to the art skilled person in solving the corrosion problems encountered with post-tensioned cables in existing concrete structures, the problems caused by water infiltrated into the cable sheath still remain. These problems are corrosion due to residual water left after grouting and incomplete bonding between the grout and the cable if water is enclosed in the resin or if insufficient water is present in the cable sheath for a hydrophillic grouting resin to fully cure. Therefore, a grouting system for post-tensioned cables in existing concrete structures is desired which will overcome these problems.

SUMMARY OF THE INVENTION

It is now an object of the present invention to provide a system for the grouting of post-tensioned cables in existing concrete structures which will operate irrespective of whether or not water is present in the cable sheath prior to or during the grouting operation.

It is yet another object of the invention to provide a grouting system wherein a curable grouting material is used which is hydrophobic and of sufficient viscosity to expel all water present and to fill all voids in the cable sheath with the grouting material. The granting material preferably completely seals off the cable once fully cured to prevent further corrosion thereof.

It is a further object of the invention to provide a grouting system wherein the grouting material used is a curable hydrophobic polymeric material.

It is still another object of the invention to provide a grouting system where in the grouting material provides sufficient bond strength to the cable and the sheath to prevent the sudden eruption of the cable from the surrounding building situation.

Accordingly, the present invention provides a method for the grouting of post-tensioned cables in existing concrete structures which cables are enclosed in a cable sheath or tubing, including the steps of pumping a curable hydrophobic grouting material into the cable sheath or tube, to fill a selected length thereof with the grouting material, and stopping the pumping operation when the cable sheath is filled with the grouting material.

The grouting material preferably has a viscosity which is selected sufficiently low for penetration of the material into all voids in the cable sheath.

In a preferred embodiment, the method includes the additional steps of providing a grout injection opening for introduction of the grouting material thereinto and a grout exit opening for the drainage of excess grout injected into the cable sheath. The grout injection and exit openings are positioned at opposite ends of the cable sheath.

BRIEF DESCRIPTION OF THE DRAWING

An exemplary embodiment of the invention will be described in detail in the following and with reference to the attached drawings, wherein.

DETAILED DESCRIPTION OF THE PREFERRED EMBODIMENT

Figure 1:
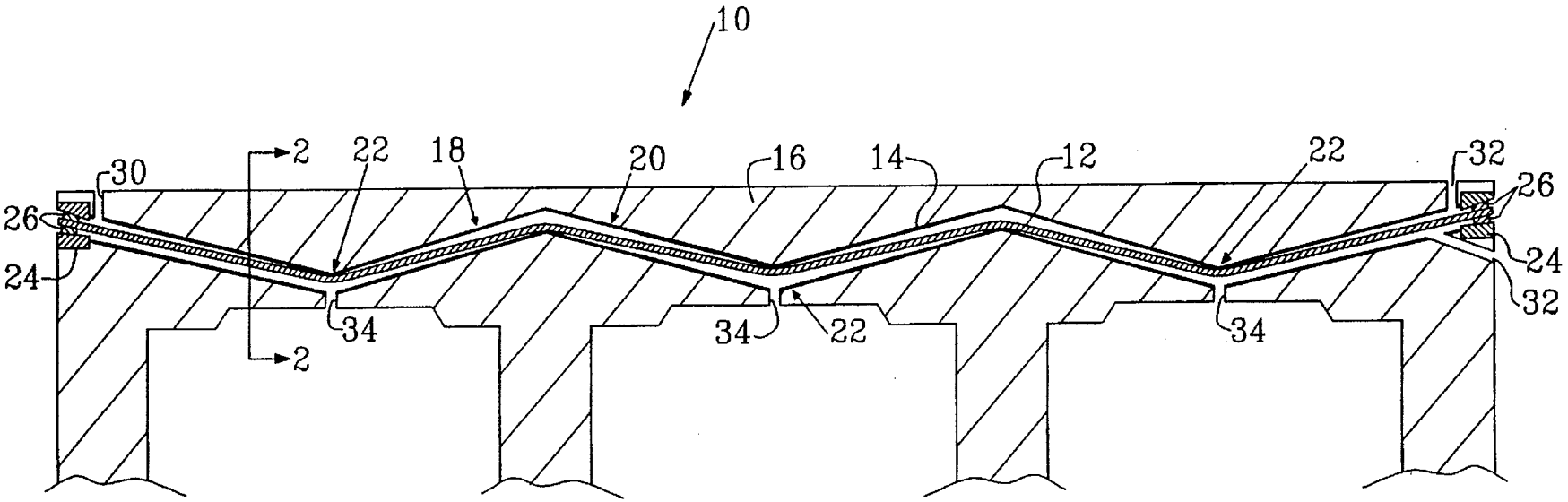
FIG. 1 is a cross-section through a concrete slab with a post-tensioned cable.
Figure 2:
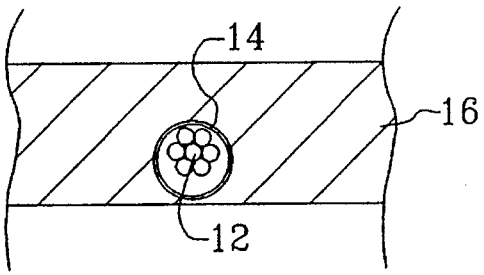
FIG. 2 is a cross-section through the concrete slab shown in FIG. 1 along line A—A.

As shown in FIGS. 1 and 2, a typical post-tensioned concrete structure such as a slab 10 includes one or more post-tensioned cables 12 (only one shown) which are positioned in plastic tubes or ducts that form a sheath 14 for the cable and are embedded into the concrete matrix 16 of the slab. The sheath 14 is positioned in a generally horizontal position, but has upwardly and downwardly inclined sections 18, 20, since it is positioned parallel to the major lines of tensile stress of the structure into which it is embedded. Water which infiltrates the sheath 14 through cracks in the concrete matrix 16 and the sheath 14 or through anchors 24 accumulates at low points 22 of the sheath. Cable 12 is maintained in its tensioned condition by way of anchors 24 embedded into a side surface of the slab 10 and circumferentially spaced apart locking wedges 26 which prevent sliding of the cable through the anchors.

In the preferred method of the invention, grouting material is injected through gaps (not shown) between the locking wedges 26 in one of the anchors 24 (injection gaps) and injection continued at least until grouting material is expelled through the gaps (not shown) between the locking wedges 26 in the other anchor 24 (drainage gaps) located at the opposite end of the cable 12. A blockage test may be performed prior to injection by blowing air through the cable sheath in order to detect obstructions in the sheath which may cause premature termination of injection prior to complete filling of the sheath. Where access to the anchors is restricted or the wedges are too closely spaced leaving injection and drainage gaps of insufficient size, the sheath 14 is provided with a grout injection port 30 and an excess grout drainage port 32 which are respectively positioned at the anchors 24 of the cable 12. In dead end arrangements where one of the anchors 24 of the cable 12 is completely embedded into the concrete matrix 16 and, thus, inaccessible for injection of the grouting material, an injection port 30 is provided which enters the sheath 14 as close as possible to the embedded anchor. A conventional grout pumping arrangement (not illustrated), preferably either a hydraulic pump connected to the injection gaps or port 30 or a vacuum pump connected to the drainage gaps or port 32 is used for forcing the grouting material into the sheath 14. The grouting material is a curable polymeric composition which is pumpable in the uncured condition, is hydrophobic, and is of sufficiently low viscosity to fill all voids in the cable sheath 14 in order to provide for complete embedding of the cable 12 in the grout. Although a complete filling of the voids in the cable sheath 14 would be more easily achieved the lower the viscosity of the grouting material, the water expelling action of very low viscosity materials is not satisfactory. The optimum viscosity of the grouting material will vary depending on the parameters of the respective application, but resin mixtures of respectively average viscosity provide satisfactory results. The grouting material used in a preferred embodiment of the invention has a sufficient pot-life to allow grouting of the whole sheath 14 with one batch of material. The pot-life required for the grouting of an average length cable is about 1.5 hours.

Intermediate ports 34 are provided if the length of the cable sheath 14 would require an uneconomical amount of pumping power for the grouting of the sheath in one step. The intermediate ports 34 can be placed anywhere between the injection and drainage gaps or ports 30 and 32, but are most appropriately positioned at the low points 22, since this will automatically remove the bulk of the infiltrated water accumulated at those points. It will be readily understood that if intermediate ports 34 are created, materials with a shorter pot-life can be used, as long as the filling of a complete section of the sheath located between adjacent ports can still be achieved with one batch of material. Also, when grouting a cable sheath 14 provided with intermediate ports 34, the pumping arrangement is connected with those ports which respectively function as the injection or drainage port, depending on whether a pressure or vacuum pumping arrangement is used.

At the start of the grouting operation, the grouting material is forced into the sheath 14 through the injection gaps or port 30. Injection of the grouting material is continued until grouting material is expelled from the next port downstream of the injection site in flow direction of the grouting material, which is either the drainage gaps or port 32 or an intermediate port 34. The expelled material is periodically tested for admixed water.

Injection of the grouting material is stopped once the expelled material no longer contains any admixed water. Since a hydrophobic grouting material is used, substantially all water present in the cable sheath 14 is expelled with the grouting material and in the head of the grouting material pumped through the sheath. Therefore, if the expelled grouting material no longer contains any admixed water, the cable sheath 14 and the cable 12 are substantially free of water. Furthermore, if any water should infiltrate the cable sheath 14 during the grouting operation, this infiltrated water will be kept away from the cable 12 due to the hydrophobic nature of the grout. Once the grouting material is cured, it remains hydrophobic and water resistant and completely surrounds the cable 12. The injection port 30 is then plugged by conventional means according to local building and fire safety codes. If no intermediate ports 34 were drilled into the cable sheath 14, the drainage port 32 is also plugged and the grouting operation is complete. However, if intermediate ports 34 were created, the injection of grouting material into the sheath 14 is recommenced after plugging of the injection port 30 and through that port from which the grouting material was expelled last. Once again, injection is continued until the grouting material expelled from the next downstream port is free of admixed water at which point injection is stopped and the port through which the grouting material was injected is plugged. The injection, testing and plugging operations are repeated until all sections of the sheath are completely filled with grouting material and all ports 30, 32 and 34 are plugged. The cable 12 is then substantially completely sealed off and corrosion thereof prevented. Furthermore, due to the tensile strength of the grouting material aided by the substantially complete removal of all water from the cable sheath 14, a bond is created between the cable 12 and the sheath which prevents a sudden and complete release of the stored energy should the cable break.

Tests run by the applicant have shown that hydrophillic grouting compositions such as those disclosed in the above discussed prior art are not satisfactory irrespective of their viscosity, since residual infiltrated water remains in the sheath after grouting which water is either bound to or enclosed in the resin so that further corrosion of the cable is possible. The residual water also decreases the bonding strength between the conventional grouting material and the cable embedded therein. Furthermore, hydrophillic polymeric grouting materials such as those disclosed in the prior art tend to shrink during and after curing which can lead to cracks in the grout and subsequent further corrosion of the cable embedded therein. These problems are overcome with a hydrophobic grouting material, since the grout and water phases will not readily mix with the result that substantially all infiltrated water can be expelled from the sheath 14 with the grouting material.

Prior to the grouting operation, heavily greased cables can be subjected to a conventional cleaning/flushing treatment for removal of a major portion of the grease coating. Furthermore, in situations where an optimal bond between the post-tensioned cable and the resin composition is desired, the cable and its sheath can be dried with conventional methods prior to grouting, for example by blowing heated air or inert gas through the sheath using a conventional blower/heater arrangement.

The preferred grouting materials used in the method of the invention are polyurethane resin compositions which include the following components in the indicated amounts:

| | |
|---|---|
| Hydroxyl-terminated butadiene | 30–35%/wt |
| Prepolymer with terminal isocyanate residues | 5–20%/wt |
| Amine catalyst | <0.1%/wt |
| Phthalate | 40–60%/wt |

The polyurethane resin composition preferred for use in the method of the present invention includes about 32% hydroxyl-terminated butadiene, about 15% prepolymer, 0.08% amine catalyst and about 53% phthalate.

Although this is the preferred grouting composition, persons skilled in the art will be readily able to select other curable hydrophobic compositions which are water resistant in their cured condition and can be employed at viscosities which will permit a complete filling of all voids in the cable sheath 14.

The invention has been described in detail with reference to one particularly preferred embodiment only, but it will be readily understood by a person skilled in the art that changes and modifications can be carried out without departing from the invention. All changes and modifications to the above embodiment which do not fall outside of the working principle of the invention are intended to be included in the appended claims which alone define the scope of the present invention.

We claim:

1. A method for preventing or arresting corrosion of an unbonded post-tensioned cable which extends through a cable sheath embedded in a concrete structure which corrosion is caused by water present in the cable sheath, comprising the steps of:

providing a grout injection opening for introduction of a grouting material into the cable sheath and a grout exit opening for drainage of excess grouting material injected into the cable sheath;

pumping the grouting material into the cable sheath through the injection opening to fill a selected length of the cable sheath with the grouting material;

testing grouting material expelled from the grout exit opening for water suspended therein; and stopping the pumping operation when the grouting material expelled is substantially free of suspended water; whereby the grouting material is a hydrophobic composition which is curable in the sheath and capable of expelling substantially all the water present in the sheath.

2. A method as defined in claim 1, including the further step of plugging the grout injection and exit openings after the step of stopping the pumping operation.

3. A method as defined in claim 1, further including the step of providing an intermediate opening for injection and drainage of the grouting material into and from the cable sheath, the intermediate opening being positioned between the grout injection and the exit openings.

4. A method as defined in claim 3, wherein the steps of pumping and stopping are repeated for each section of the cable sheath located between adjacent openings, and the method includes the further step of testing grouting material expelled from the cable sheath for admixed water, the pumping operation being continued until the material expelled is substantially free of water.

5. A method as defined in claim 4, wherein after each stopping step the method includes the further step of plugging that opening through which the grouting material was pumped into the sheath, the filling of the cable sheath being carried out in the direction from the grout injection opening to the grout exit opening.

6. A method as defined in claim 5, wherein the cable sheath has a pair of oppositely inclined sections meeting at a low point, the intermediate opening being positioned at the low point for draining of infiltrated water from the cable sheath which has accumulated at the low point.

7. A method as defined in claim 1, wherein the grouting material is a curable hydrophobic polymeric resin.

8. A method as defined in claim 7, wherein the grouting material is a hydrophobic polyurethane resin.

9. A method as defined in claim 8, wherein the grouting material includes 30–35%/wt hydroxyl-terminated butadiene, 5–20%/wt prepolymer with terminal isocyanate residues, less than 0.1%/wt of an amine catalyst and 40–60%/wt phthalate.

* * * * *